US010535926B2

(12) United States Patent
Lee

(10) Patent No.: US 10,535,926 B2
(45) Date of Patent: Jan. 14, 2020

(54) ANTENNA AND ANTENNA MODULE COMPRISING THE SAME

(71) Applicant: Tyco Electronics AMP Korea Co. Ltd, Gyungsangbuk-do (KR)

(72) Inventor: Chang Hyun Lee, Gyeonggi-do (KR)

(73) Assignee: Tyco Electronics AMP Korea Co., Ltd., Gyeongsan (KR)

( * ) Notice: Subject to any disclaimer, the term of this patent is extended or adjusted under 35 U.S.C. 154(b) by 0 days.

(21) Appl. No.: 15/443,621

(22) Filed: Feb. 27, 2017

(65) Prior Publication Data

US 2017/0250471 A1 Aug. 31, 2017

(30) Foreign Application Priority Data

Feb. 29, 2016 (KR) ..... 10-2016-0024560

(51) Int. Cl.

| | |
|---|---|
| ***H01Q 9/04*** | (2006.01) |
| ***H01Q 1/22*** | (2006.01) |
| ***H01Q 1/48*** | (2006.01) |
| ***H01Q 21/00*** | (2006.01) |
| ***H01Q 9/40*** | (2006.01) |

(52) U.S. Cl.

CPC ..... *H01Q 9/0421* (2013.01); *H01Q 1/2291* (2013.01); *H01Q 9/0407* (2013.01); *H01Q 9/40* (2013.01)

(58) Field of Classification Search

CPC ..... H01Q 9/0421; H01Q 9/40; H01Q 9/0407; H01Q 1/48; H01Q 1/2291; H01Q 21/00

See application file for complete search history.

(56) References Cited

U.S. PATENT DOCUMENTS

| | | | |
|---|---|---|---|
| 7,411,554 | B2 | 8/2008 | Jung et al. |
| 2004/0217910 | A1 | 11/2004 | Montgomery et al. |
| 2004/0263400 | A1 | 12/2004 | Yuanzhu |
| 2005/0001768 | A1 | 1/2005 | Sekiguchi et al. |

(Continued)

FOREIGN PATENT DOCUMENTS

| | | | |
|---|---|---|---|
| EP | 0376643 | A2 | 7/1990 |
| JP | 2015-173325 | A | 10/2015 |
| KR | 100794788 | B1 | 1/2008 |

OTHER PUBLICATIONS

Extended European Search Report dated Aug. 9, 2017, for European Patent Application No. 17157836.2.

(Continued)

*Primary Examiner* — Hai V Tran
*Assistant Examiner* — Michael M Bouizza

(57) ABSTRACT

An antenna including a planar radiator that exhibits the same shape at least twice in response to a 360-degree rotation based on a single virtual line and has a plurality of conductive legs connected to the planar radiator. The conductive legs exhibit the same shape at least twice in response to the 360-degree rotation based on the single virtual line. An antenna module that includes an antenna exhibiting the same shape at least twice in response to a 360-degree rotation based on a single virtual line with the antenna having a planar radiator and a plurality of conductive legs connected to the planar radiator. The antenna module also includes a substrate having a plurality of pads each corresponding to one of the conductive legs of the antenna.

5 Claims, 15 Drawing Sheets

(56) References Cited

U.S. PATENT DOCUMENTS

| | | | | |
|---|---|---|---|---|
| 2005/0116875 | A1* | 6/2005 | Yuanzhu | H01Q 1/243<br>343/846 |
| 2008/0074327 | A1* | 3/2008 | Noro | H01Q 9/0421<br>343/700 MS |
| 2010/0289705 | A1 | 11/2010 | Shtrom et al. | |
| 2013/0180967 | A1* | 7/2013 | Teng | B23Q 17/20<br>219/121.69 |

OTHER PUBLICATIONS

Official Communication dated Feb. 22, 2019, for EP 17157836.2.
Communication dated Jul. 27, 2018 for EP 17157836.2.

* cited by examiner

ANTENNA AND ANTENNA MODULE COMPRISING THE SAME

CROSS-REFERENCE TO RELATED APPLICATIONS

This application claims the benefit of the filing date under 35 U.S.C. § 119(a)-(d) of Korean Patent Application No. 10-2016-0024560 filed on Feb. 29, 2016.

FIELD OF THE INVENTION

The present invention relates, in general, to antennas and antenna modules and, in particular, to an antenna and an antenna module used as a multiple input multiple output (MIMO) antenna, a monopole antenna, a planar inverted F antenna (PIFA), and the like.

BACKGROUND

An antenna refers to a part formed using a conductor that transmits electric waves to another location or receives electric waves from the location to perform radio communication and may be applied to a variety of products, for example, a wireless telegraph, a wireless phone, a radio, a television, and the like. An antenna module includes a substrate and one or more antennas installed on the substrate. In general, the antenna is manufactured in a specific form suitable for the purpose and shape of a product.

Korean Patent Registration No. 10-0794788 discloses a multiple input multiple output (MIMO) antenna as an example of an antenna module. The antenna module relates to the MIMO antenna and is designed to operate in a multi-frequency band and to have a miniaturized size.

The recent demand for a high quality multimedia service using wireless mobile communication technology has accelerated the need for next-generation wireless transmission technology for transmitting a larger amount of data faster with a lower error probability. Accordingly, the MIMO antenna is proposed. The MIMO antenna performs a MIMO operation by arranging a plurality of antenna devices in a specific structure. The MIMO antenna is configured to form the entire radiation pattern in a sharp shape and to transmit electromagnetic waves to a further location by merging the radiation power and the radiation pattern of a plurality of antenna devices.

Accordingly, it is possible to enhance a data transmission rate within a specific range and to increase a system range with respect to a specific data transmission rate. The MIMO antenna is next generation mobile communication technology widely available for a mobile communication terminal, a repeater, and the like, and has been gaining interest as next generation technology beyond a transmission amount limit of mobile communication close to a critical situation due to a data communication expansion, etc.

Meanwhile, various types of wireless communication services, for example, a global positioning system (GPS), wireless fidelity (WiFi), a wireless local area network (WLAN), wireless Broadband Internet (WiBro), Bluetooth, etc., available at a wireless terminal, have been currently developed. A reconfigurable antenna module is required to use each wireless communication service using a single wireless terminal.

In the case of a general MIMO antenna, one or more pairs of antennas in a complex and symmetrical shape need to be symmetrically disposed into consideration of optimization of a radiation pattern and prevention of interference, for example, isolation between each other. Accordingly, different two or more molds are used to manufacture the one or more pairs of antennas.

SUMMARY

One or more example embodiments provide an antenna that may achieve a symmetrical radiation pattern regardless of a peripheral environment and may be manufactured using a single mold, and an antenna module including the antenna.

An antenna, constructed in accordance with the present invention, includes a planar radiator exhibiting the same shape at least twice in response to a 360-degree rotation based on a single virtual line and a plurality of conductive legs connected to the planar radiator and exhibiting the same shape at least twice in response to the 360-degree rotation based on the single virtual line.

An antenna module, constructed in accordance with the present invention, includes an antenna exhibiting the same shape at least twice in response to a 360-degree rotation based on a single virtual line with the antenna having a planar radiator and a plurality of conductive legs connected to the planar radiator. This antenna module also includes a substrate comprising a plurality of pads each corresponding to one of the conductive legs of the antenna.

BRIEF DESCRIPTION OF THE DRAWINGS

These and/or other aspects, features, and advantages of the present invention will become apparent and more readily appreciated from the following description of example embodiments, taken in conjunction with the accompanying drawings of which.

DETAILED DESCRIPTION OF THE EMBODIMENT(S)

Figure 1:
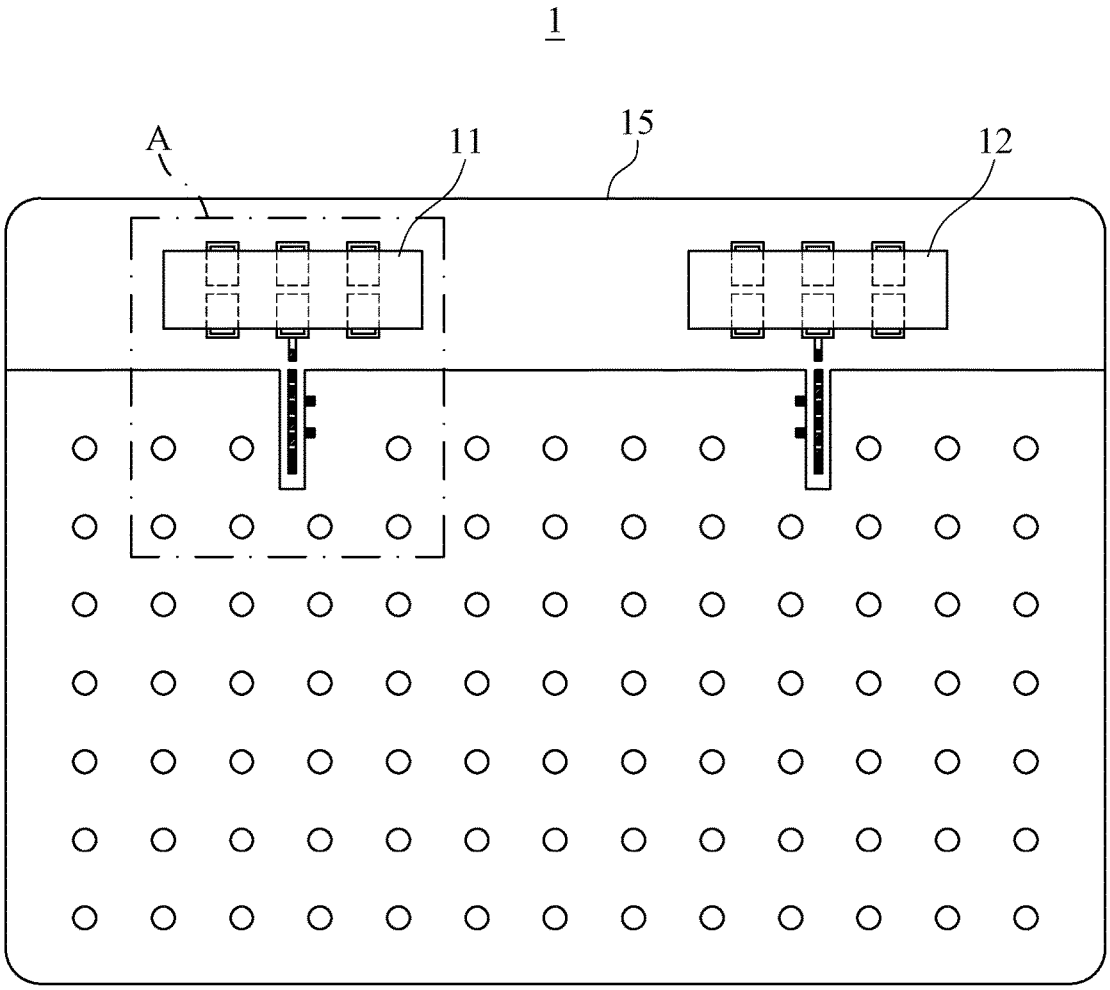
FIG. 1 illustrates an antenna module according to an example embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of example embodiments, detailed description of well-known related structures or functions will be omitted when it is deemed that such description will cause ambiguous interpretation of the present disclosure.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

A component having a common function with a component included in one example embodiment is described using a like name in another example embodiment. Unless otherwise described, a description made in one example embodiment may be applicable to another example embodiment and a detailed description within a duplicate range is omitted.

Referring to FIGS. 1 through 4, an antenna module 1 may be applicable to any type of electronic devices, for example, a mobile device, a vehicle, a wearable device, Internet of Things (IoT), etc. The antenna module 1 may include one or more antennas, for example, a first antenna 11 and a second antenna 12, and a substrate 15 to which the one or more antennas are mounted.

The one or more antennas may include the first antenna 11 and the second antenna 12 that are disposed in a symmetrical shape and alignment. Each of the first antenna 11 and the second antenna 12 forms a symmetrical radiation pattern through a symmetrical shape of a corresponding antenna. Thus, when the plurality of antennas including the first antenna 11 and the second antenna 12 are disposed symmetrically on a single antenna module 1, the plurality of antennas may have the same mutual effect and interference effect. The first antenna 11 and the second antenna 12 may be manufactured using a single identical mold due to a symmetrical structure, which is described below. For clarity of description, the first antenna 11 is also referred to as "antenna 11". Unless described otherwise, a description related to the first antenna 11 may be applicable to the second antenna 12.

Figure 2:
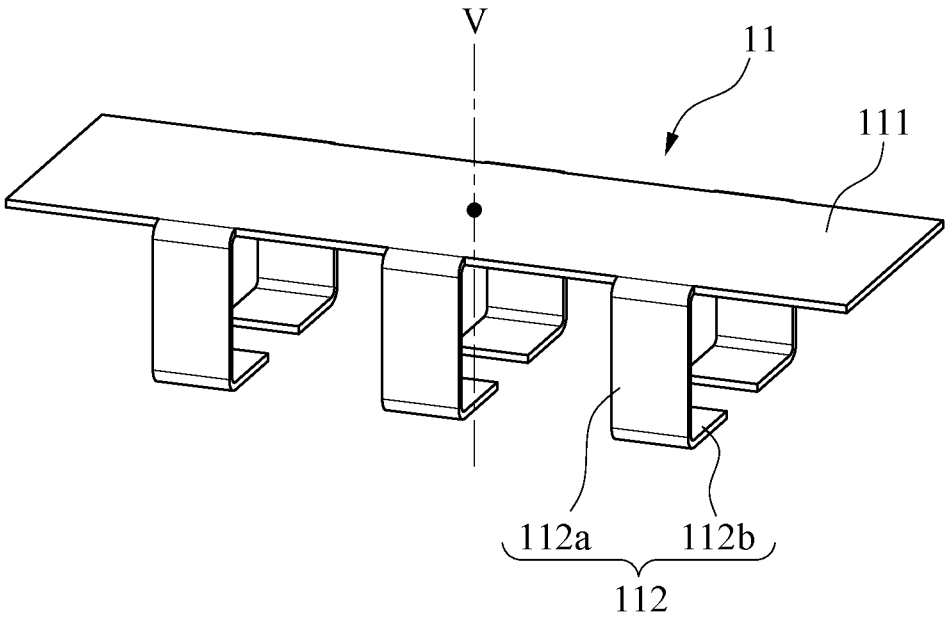
FIG. 2 is a perspective view illustrating an antenna according to an example embodiment.
Figure 3:
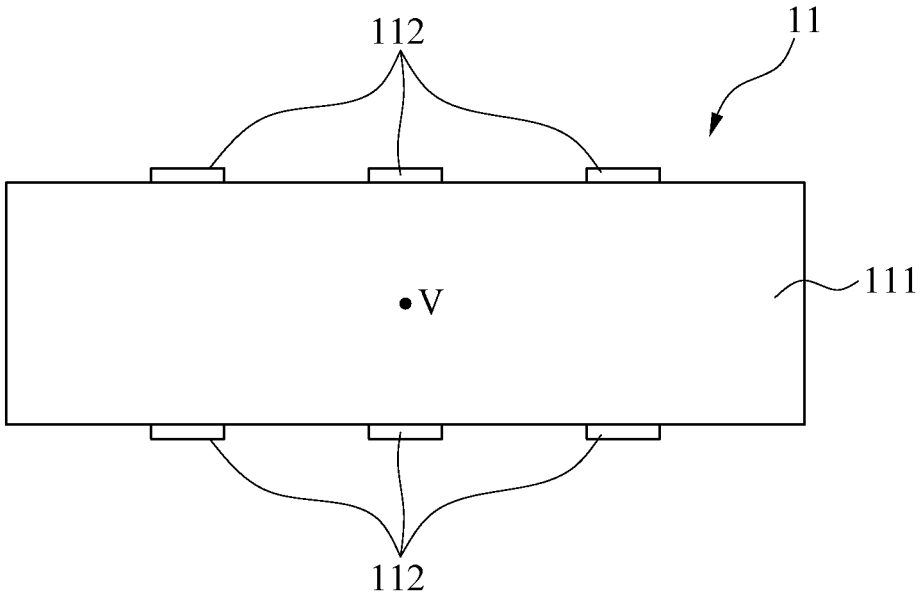
FIG. 3 is a top view illustrating an antenna according to an example embodiment.

Referring to FIGS. 1 through 3, the antenna 11 may have a symmetrical shape that exhibits the same shape at least twice in response to a 360-degree rotation based on a single virtual line V. For example, the antenna 11 may have a point-symmetrical shape.

The antenna 11 may include a planar radiator 111 and a plurality of conductive legs 112 connected to the planar radiator 111. The planar radiator 111 may be in a symmetrical shape that exhibits the same shape at least twice in response to a 360-degree rotation based on a single virtual line V.

The plurality of conductive legs 112 may be in a symmetrical shape that exhibits the same shape at least twice in response to a 360-degree rotation based on the single virtual line V. For example, referring to FIGS. 1 through 3, the plurality of conductive legs 112 may be disposed in the symmetrical shape that exhibits the same shape at least twice when the plurality of conductive legs 112 rotate 360 degrees based on the single virtual line V. Here, each of at least two conductive legs among the plurality of conductive legs 112 may include a vertical portion 112*a* bent from the outer periphery of the planar radiator 111 and a horizontal portion 112*b* bent inward from the vertical portion 112*a*. For example, the vertical portion 112*a* and the horizontal portion 112*b* may be formed using a planar material.

The planar radiator 111 and the vertical portions 112*a* and the horizontal portions 112*b* of the conductive legs 112 may be manufactured using a single mold, or may be integrally formed using a method of cutting and bending a single planar conductor.

The antenna 11 may be formed through a process of cutting and bending an antenna development shape including an antenna shape, a slot, etc., using a press scheme. Also, the antenna 11 may be formed using a laser direct structuring (LDS) scheme, a molded interconnect device (MID), a flexible printed circuit board (FPCB), and the like.

The antenna 11 may be used as a multiple input multiple output (MIMO) antenna, a monopole antenna, a planar inverted F antenna (PIFA), and the like. For example, in the case of using one of the plurality of conductive legs 112 included in the antenna 11 as a power supplying leg, the antenna 11 may serve as the monopole antenna. As another example, in the case of using one of the plurality of conductive legs 112 included in the antenna 11 as the power supplying leg and using another one of the conductive legs 112 as a ground leg, the antenna 11 may serve as the PIFA. Also, in the above two cases, the antenna 11 is in a symmetrical structure and may form a symmetrical radiation pattern due to the symmetrical shape of the antenna 11.

The antenna 11 according to an example embodiment may be distinguished from a patch antenna as follows. The patch antenna is generally called a micro-strip antenna and designed based on a ground plate using a printed circuit board (PCB), a dielectric plate, and a strip line. However, the antenna 11 according to an example embodiment is configured based on a ground fill-cut condition, so that an alignment location of the planar radiator 111 may achieve a maximum radiation effect and thus, may be understood as an antenna capable of satisfying types, such as the monopole antenna or the PIFA, based on a symmetrical radiator type, which differs from a micro-strip antenna. In detail, the patch antenna is designed based on the ground plate, the dielectric plate, and the strip line, whereas a general antenna, such as a general monopole antenna, a PIFA, etc., is designed to satisfy a 50 ohm impedance condition and to help the formation of a desired resonance frequency band using an antenna design and a matching component based on the ground fill-cut condition.

The substrate 15 may include a ground portion 151 for grounding, a plurality of pads P configured to electrically connect to the antenna 11, an antenna receiver 153 on which the plurality of pads P are disposed, and a power feeder 157 to feed a power to one or more pads P among the plurality of pads P.

A via-hole 152 to increase a ground effect may be formed in the ground portion 151. For example, when the ground portion 151 includes three layers, a capacitance component may be formed between a bottom layer and a top layer. However, by connecting the bottom layer and the top layer using the via-hole 152, it is possible to prevent the capacitance component from being formed between the bottom layer and the top layer. That is, the via-hole 152 may decrease, or alternatively, minimize undesired parasitic components.

The plurality of pads P corresponding to the plurality of conductive legs 112, respectively, may be provided to the antenna receiver 153. For example, referring to FIGS. 1 through 4, when the antenna 11 includes six conductive legs 112, six pads P may be included in the antenna receiver 153.

The plurality of pads P may include at least one signal pad (SP1, SP2, SP3) to supply current through at least one conductive leg 112. The signal pad (SP1, SP2, SP3) may be connected to the power feeder 157 to transfer the current to the planar radiator 111. The conductive leg 112 connected to the signal pad (SP1, SP2, SP3) may also be referred to as a power supplying leg.

The plurality of pads P may further include at least one ground pad (GP1, GP2) to connect to one or more conductive legs 112 among the plurality of conductive legs 112. The ground pad (GP1, GP2) may be connected to the ground portion 151 and may serve as ground. Meanwhile, the conductive leg 112 connected to the ground pad (GP1, GP2) may also be referred to as a ground connector.

The plurality of pads P may further include a fixing pad FP to fix to at least one conductive leg 112 among the plurality of conductive legs 112 using soldering. The fixing pad FP may further secure coupling of the antenna 11.

Figure 4:
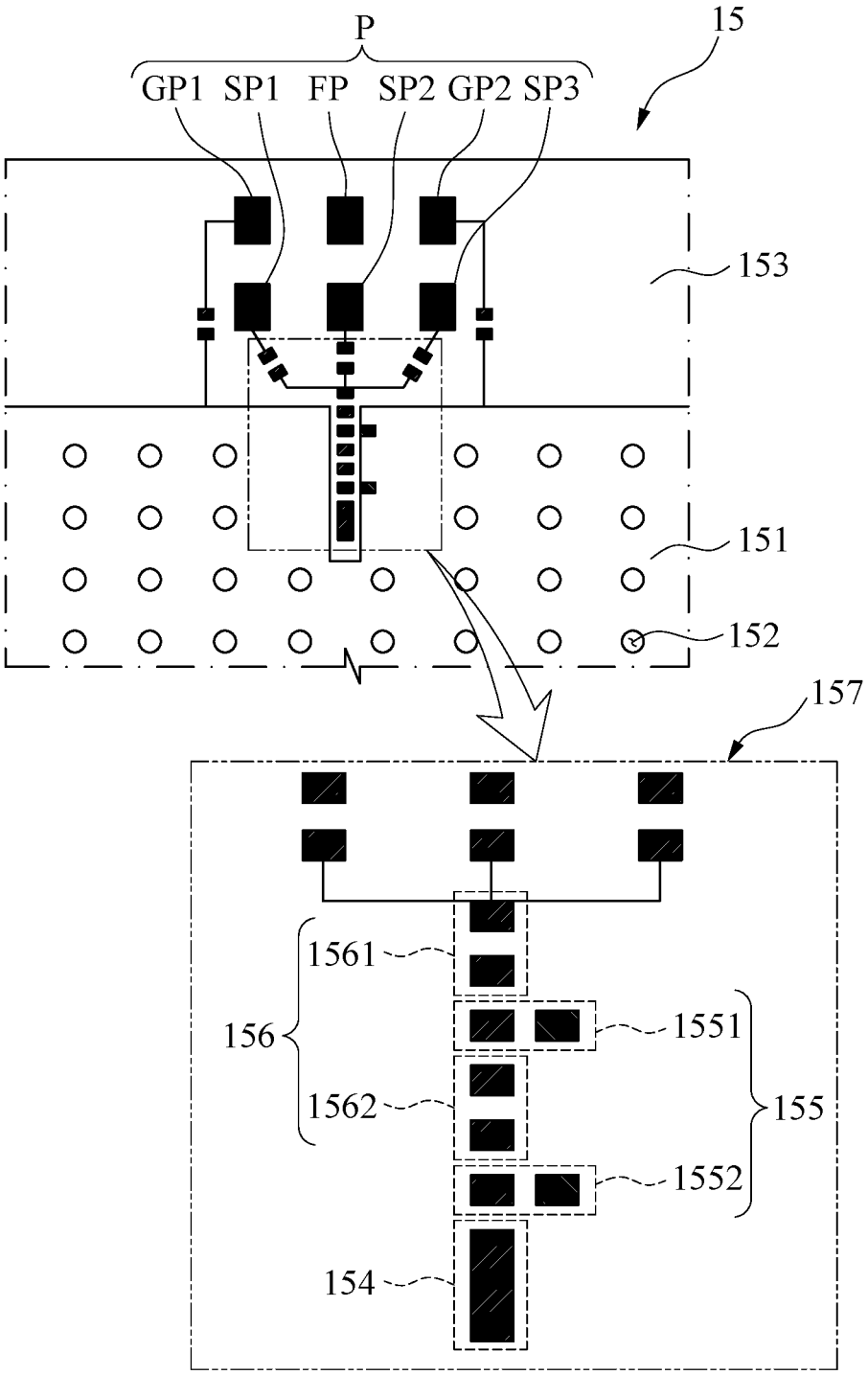
FIG. 4 illustrates a substrate of an antenna module according to an example embodiment.

FIG. 4 is provided as an example only and the signal pads (SP1, SP2, SP3), the ground pads (GP1, GP2), and the fixing pad (FP) may be switched and thereby used based on design specification. A portion of the signal pads, the ground pads, and the fixing pad may be omitted and a number of signal pads, a number of ground pads, and a number of fixing pads may be modified. According to an example embodiment, it is possible to manufacture an antenna module having a plurality of properties using the same substrate. Accordingly, it is possible to enhance the productivity of the antenna module. That is, a radiation type and characteristic may vary based on a signal pad selected to connect to a power feeder 157 and, thus, it is possible to employ a single antenna module for a plurality of purposes.

For example, one or more signal pads (SP1, SP2, SP3) may include a first signal pad SP2 positioned at the center of the plurality of pads P. One or more ground pads (GP1, GP2) may include a first ground pad GP1 and a second ground pad GP2 that are symmetrically disposed based on the first signal pad SP2.

In detail, the plurality of pads P may be disposed in an alignment, for example, a 2×3 alignment, including two rows and three columns. Here, at least one ground pad (GP1, GP2) may be positioned on a first row of the alignment, at least one signal pad (SP1, SP2, SP3) may be positioned on a second row of the alignment, and the fixing pad FP positioned on the center of the first row of the alignment may be fixed to a single conductive leg 112 among the plurality of conductive legs 112 using soldering. Alternatively, the signal pads may be positioned on the first row of the alignment and the ground pads and the fixing pad may be positioned on the second row of the alignment based on the design intent of a user.

The plurality of pads P may be connected to the antenna 11 using a passive component, for example, an inductor, capacitor, resistance, and the like. The performance thereof may vary based on a presence or absence of connection and a passive component to be applied.

The power feeder 157 may supply the current to the signal pad of the antenna 11. The power feeder 157 may include a plurality of small terminals that are available as a contact point of the passive component and separate from each other, which may be referred to as a series component pad. The series component pad may include a four-stage matching structure, for example, antenna-series-shut-series-shut, for various simulations, and may be designed for impedance matching by appropriately using the passive component for each terminal. Meanwhile, the two series are to be connected to each other and the shunt may be processed to non-connect based on an impedance matching condition.

For example, the power feeder 157 may include a source 154 to supply the current to the antenna 11, a series portion 156 to serve as a passage for transferring the current from the source 154 to the antenna 11, and a shunt portion 155 to connect to the series portion 156.

The series portion 156 may include a first series pad 1561 disposed to be close to the signal pad (SP1, SP2, SP3) and a second series pad 1562 disposed to be close to the source 154. One end of the first series pad 1561 and one end of the second series pad 1562 may be electrically connected to each other. Various types of passive components may be connected to the first series pad 1561 and the second series pad 1562 using soldering and the like. In this manner, the current may flow in the entire series portion 156.

One end of the shunt portion 155 may be electrically connected to the series portion 156 and another end of the shunt portion 155 may be connected to the ground portion 151. If a designed matching condition is not satisfied, impedance matching may be performed by connecting the passive component to the shunt portion 155. The shunt portion 155 may include a first shunt pad 1551 to electrically connect to one end of the first series pad 1561 and one end of the second series pad 1562, and a second shunt pad 1552 to electrically connect to another end of the second series pad 1562 and one end of the source 154. Various passive components may be connected to the first shunt pad 1551 and/or the second shunt pad 1552 using soldering and the like. Based on an impedance matching condition, the first shunt pad 1551 or the second shunt pad 1552 may be processed to non-connect.

The shunt portion 155 may be used as a terminal for impedance matching. In the case of using only the power feeder 157 instead of using a ground pad, a condition similar to a ground connection as in a PIFA antenna may be provided by connecting an inductor component to the shunt portion 155. The above structure may be understood as a semi-PIFA.

Figure 5:
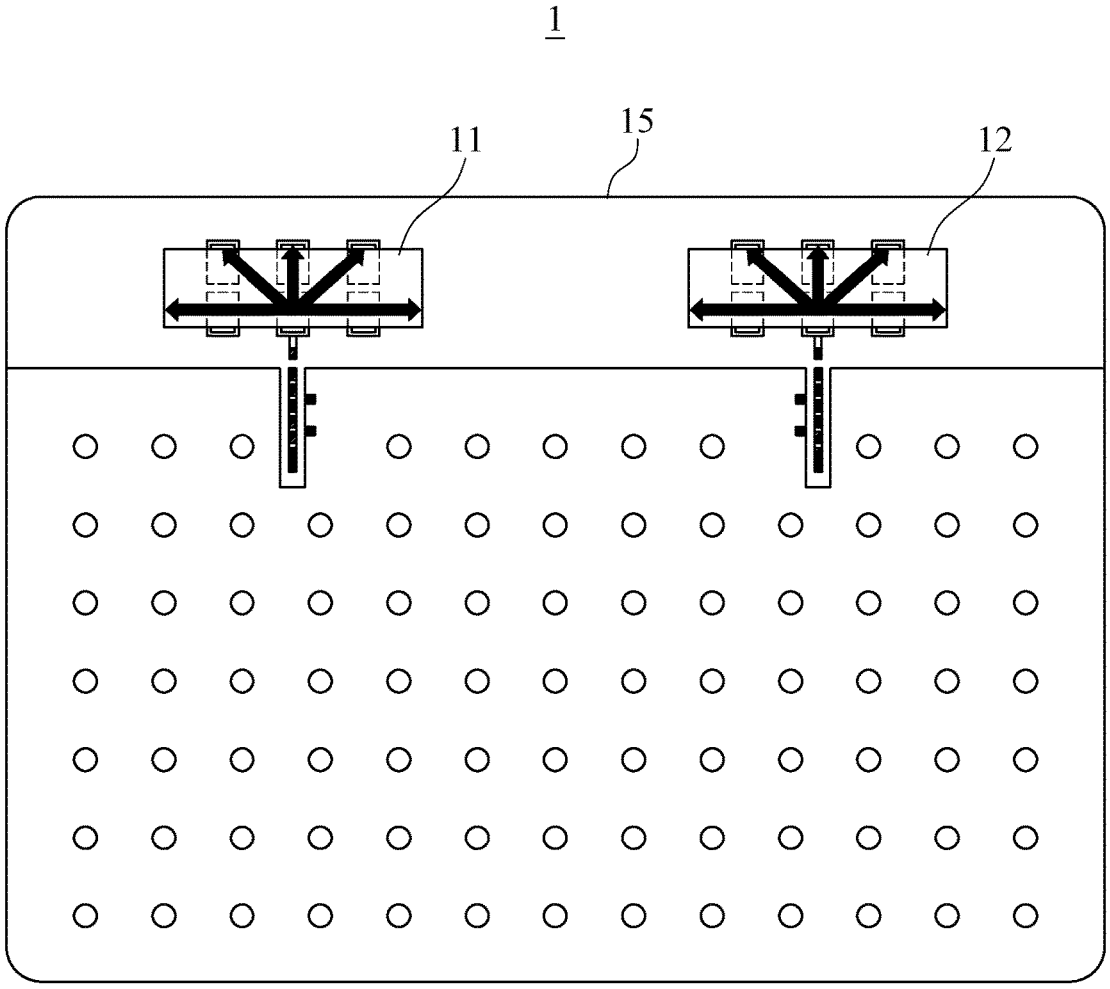
FIG. 5 illustrates a direction in which a current propagates on an antenna module according to an example embodiment.

FIG. 5 illustrates a direction in which a current propagates on an antenna module according to an example embodiment. Referring to FIG. 5, the first antenna 11 and the second antenna 12 that constitute a single pair may have the same magnitude and direction of current propagated from the power feeder 157, which differs from an existing antenna. In the case of the existing antenna, the magnitude of current varies based on a shape of the antenna. For example, the magnitude of current flowing in an area with a relatively wide width of the antenna is relatively great and the magnitude of current flowing in an area with a relatively narrow width of the antenna is small. Directions of current flowing in the respective antennas that constitute a single pair are formed in opposite directions that face each other.

Figure 6:
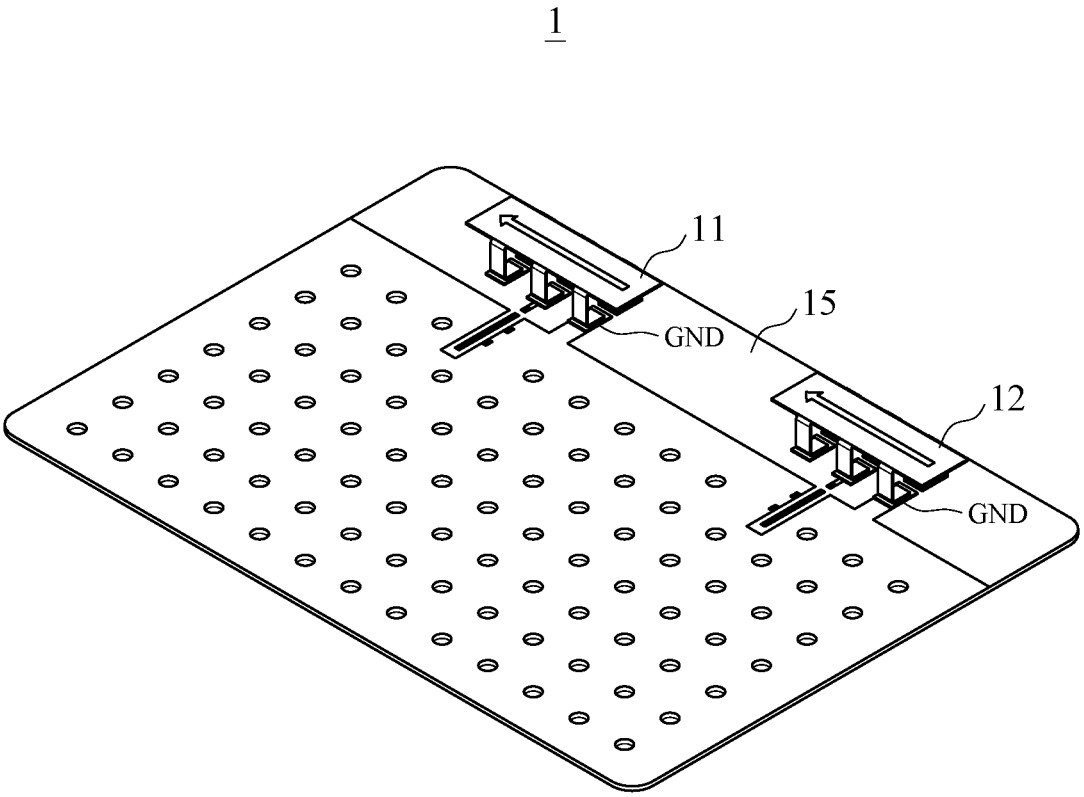
FIG. 6 illustrates a direction in which a radiation pattern propagates on an antenna module according to an example embodiment.
Figure 7:
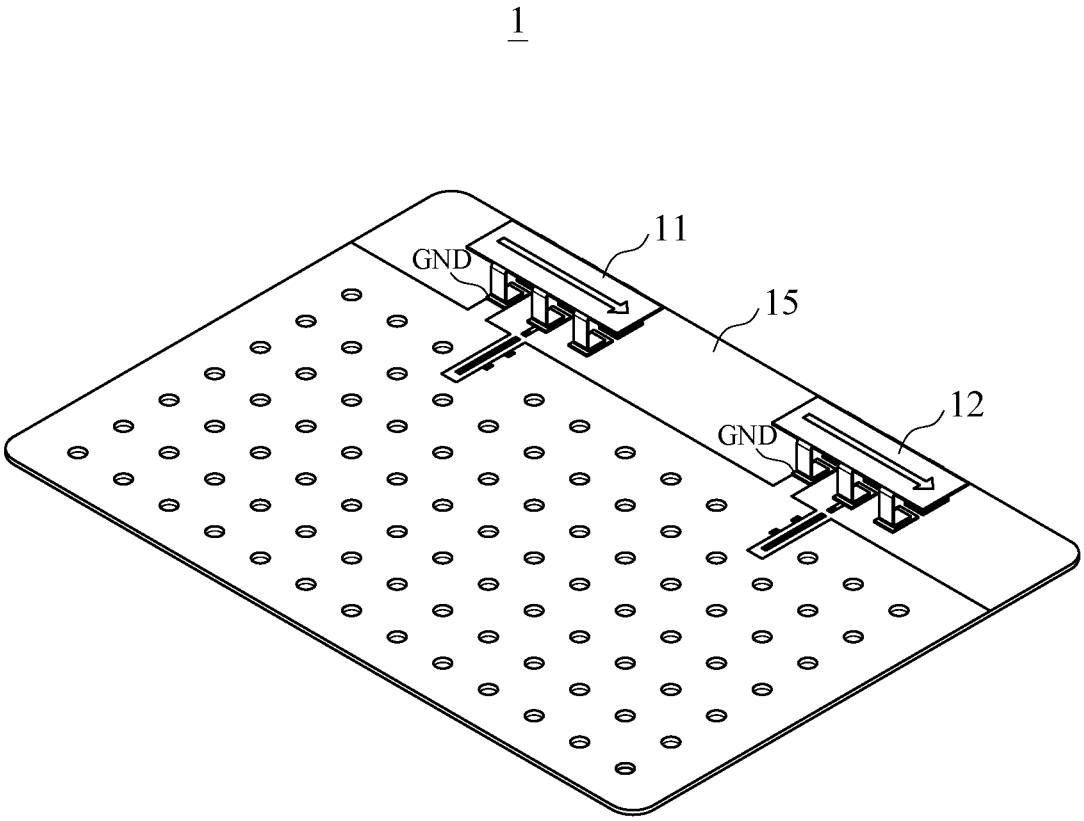
FIG. 7 illustrates a direction in which a radiation pattern propagates on an antenna module according to another example embodiment.

FIG. 6 illustrates a direction in which a radiation pattern propagates on an antenna module according to an example embodiment and FIG. 7 illustrates a direction in which a radiation pattern propagates on an antenna module according to another example embodiment. A direction of current shown in FIGS. 6 and 7 differs from the direction of current shown in FIG. 5. Since a radiation pattern is known to be propagated from a ground GND, a propagation direction of the radiation pattern is conceptually illustrated in FIGS. 6 and 7.

Referring to FIGS. 6 and 7, in the antenna module 1 according to an example embodiment, although a ground is connected to either the left or the right of the conductive leg 112 positioned at the center of the antenna 11 based on the condition that the power feeder 157 is connected to the conductive leg 112 positioned at the center of the antenna 11, the antenna module 1 may have the same impedance characteristic and the antenna 11 may be maintained to have the same performance.

Accordingly, the flow of current may be switched to the left or the right of the antenna 11 by determining a direction of the ground to be connected to the conductive leg 112 based on a desired radiation pattern. That is, a type of a radiation pattern may be changed based on the determined flow direction of current by determining a side to which the ground is to be connected.

Due to a symmetrical shape of the antenna 11, the antenna 11 does not experience a change in impedance regardless of whether the ground is connected to the left or the right of the conductive leg 112, which differs from the existing antenna. Accordingly, a single pair of antennas, for example, the first antenna 11 and the second antenna 12, having the same shape in the antenna module 1, may be symmetrically disposed and thereby used and a location of the ground may be changed based on a direction of a desired radiation pattern. That is, a radiation direction may be changed by changing a location of a ground pad based on the design intent of the user.

In the case of the existing antenna, a portion connected to a power feeder and a portion connected to a ground are determined to be clearly distinguished from each other. Accordingly, if a connection location of one of the power feeder and the ground is changed, the corresponding antenna may have an impedance characteristic different from an originally intended design, which may lead to changing the performance of the antenna. Thus, it may be almost impossible to change the performance of the antenna. The antenna 11 according to an example embodiment may overcome the above issues found in the existing antenna.

Again, referring to FIGS. 6 and 7, the antenna module 1 uses the air as a dielectric between the substrate 15 and the planar radiator 111. However, this is an example only. In addition to the air, plastic, ceramic, liquid, and the like, may be disposed between the substrate 15 and the planar radiator 111.

Figure 8:
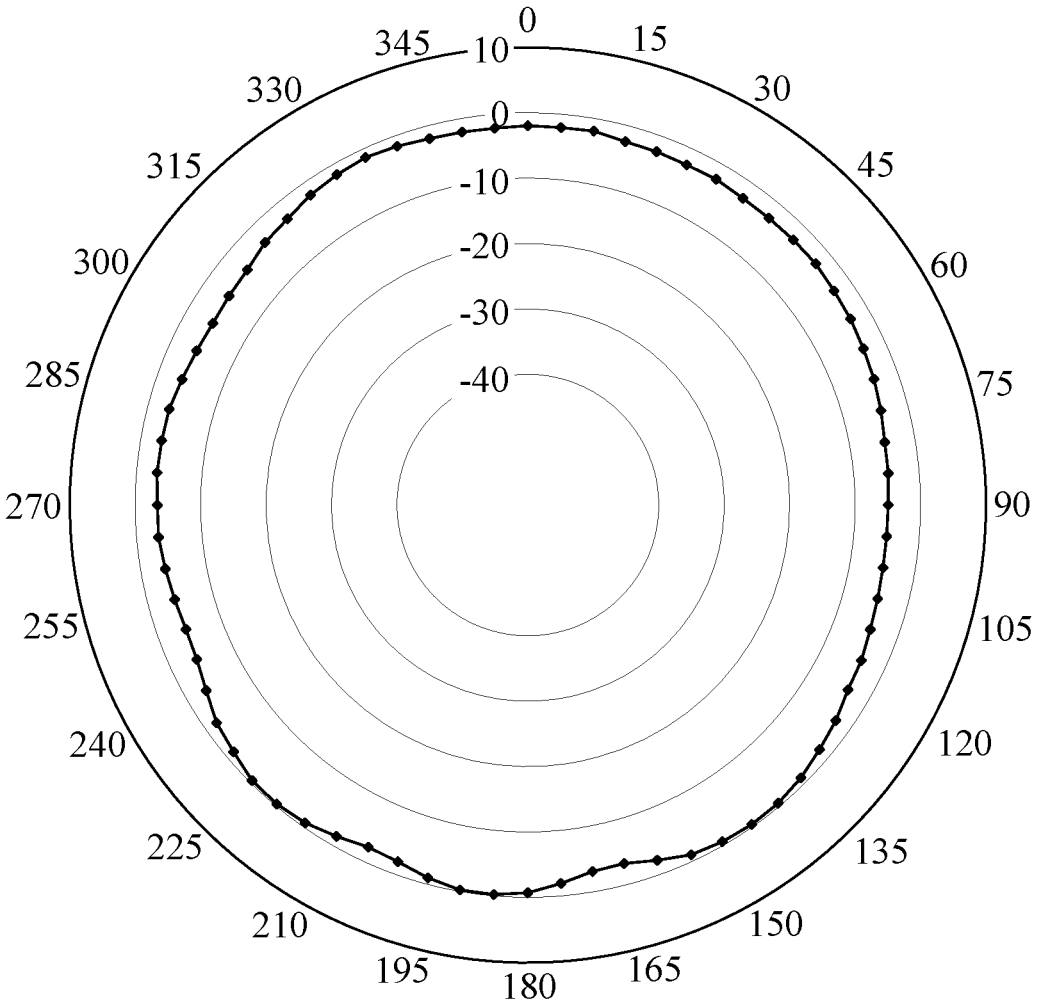
FIG. 8 illustrates an H-plane radiation pattern of an antenna according to an example embodiment.
Figure 9:
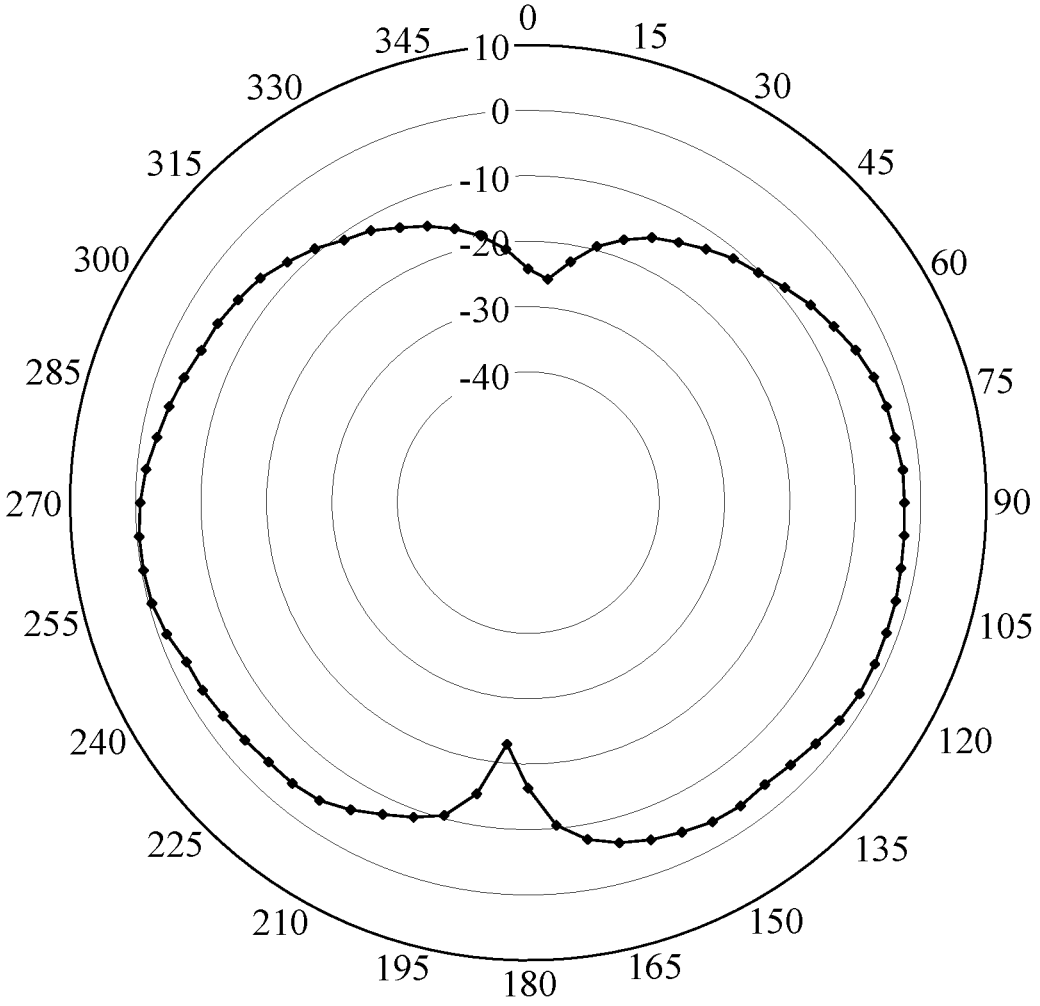
FIG. 9 illustrates an E-plane radiation pattern of an antenna according to an example embodiment.
Figure 10:
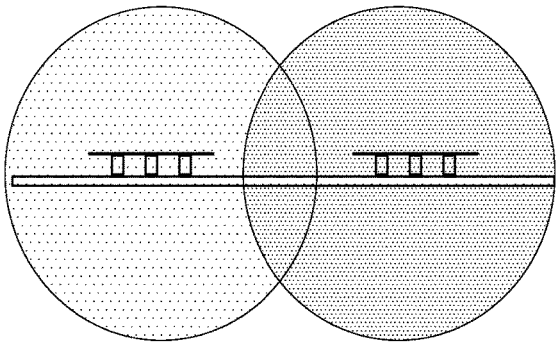
FIG. 10 illustrates an H-plane radiation pattern of an antenna module on which antennas are disposed in a 1×2 alignment according to an example embodiment.

FIG. 8 illustrates an H-plane radiation pattern of an antenna according to an example embodiment and FIG. 9 illustrates an E-plane radiation pattern of an antenna according to an example embodiment. FIG. 10 illustrates an H-plane radiation pattern of an antenna module on which antennas are disposed in a 1×2 alignment according to an example embodiment and FIG. 11 illustrates an H-plane radiation pattern of an antenna module on which antennas are disposed in a 1×4 alignment according to an example embodiment.

Referring to FIGS. 8 and 9, the antenna 11 according to an example embodiment may form a symmetrical radiation pattern due to a symmetrical shape of the antenna 11. It can be verified from both the H-plane and the E-plane.

Figure 11:
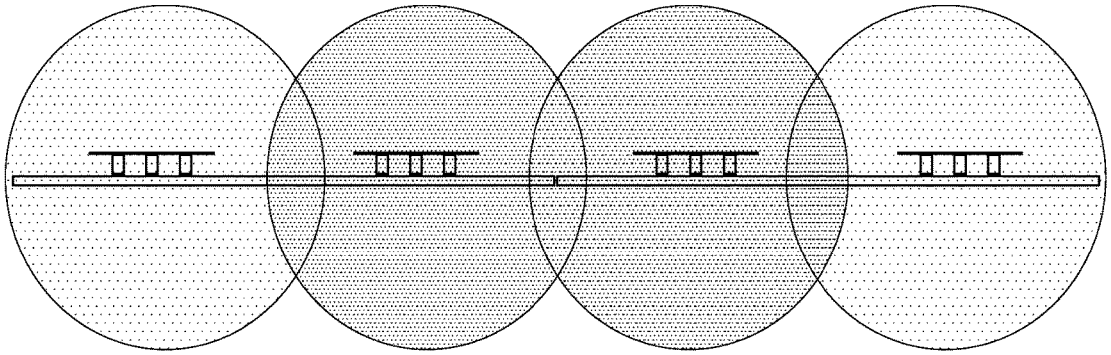
FIG. 11 illustrates an H-plane radiation pattern of an antenna module on which antennas are disposed in a 1×4 alignment according to an example embodiment.

Using the above characteristic, an omni-directional radiation pattern as shown in FIGS. 10 and 11 may be formed by disposing the same antenna 11 to be in a plurality of alignments. The antennas 11 having the omni-directional radiation pattern are distinguished from the existing antennas having a directional radiation pattern.

Figure 12A:
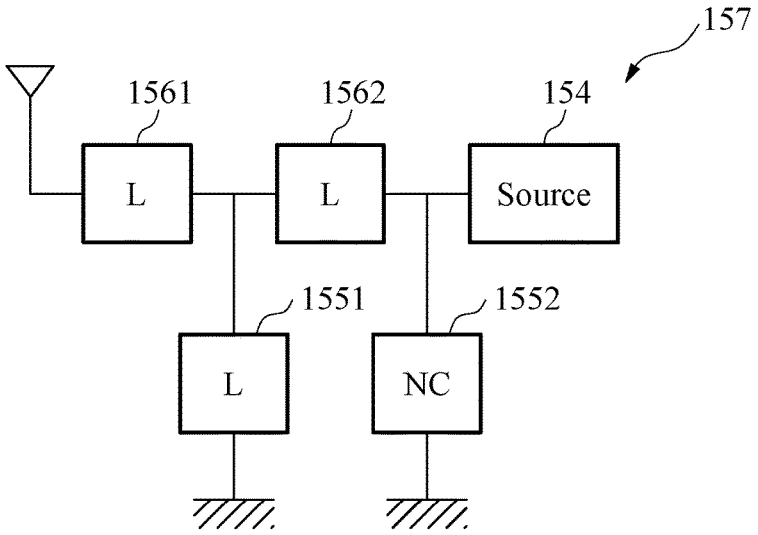
FIG. 12A illustrates a first matching circuit according to an example embodiment.
Figure 12B:
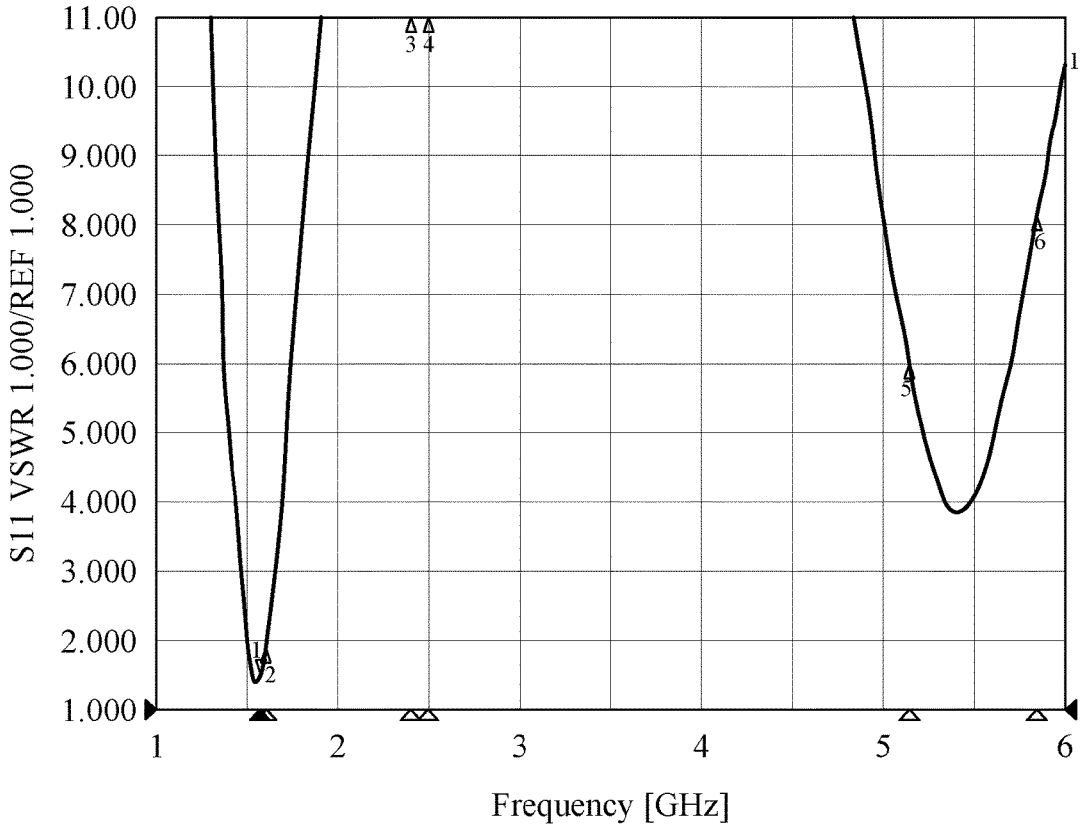
FIG. 12B is a graph showing a resonance frequency characteristic appearing in response to applying the first matching circuit of FIG. 12A to a power feeder of an antenna module according to an example embodiment.
Figure 13A:
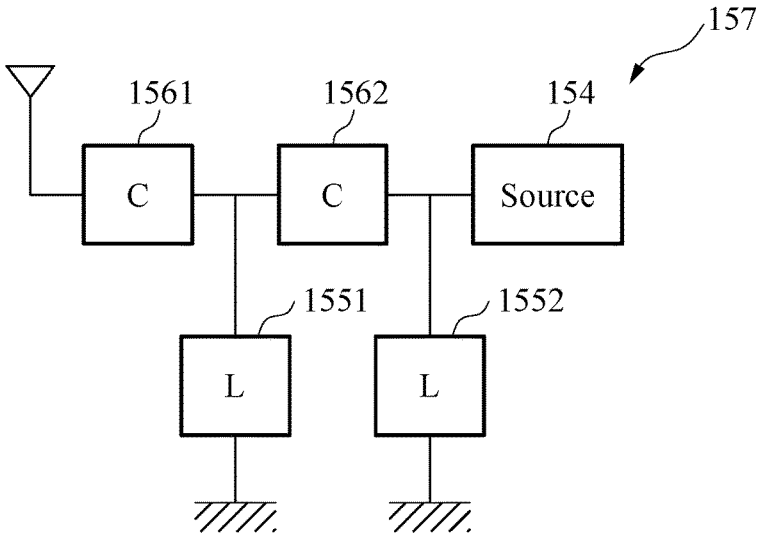
FIG. 13A illustrates a second matching circuit according to an example embodiment.

FIG. 12A illustrates a first matching circuit according to an example embodiment and FIG. 12B is a graph showing a resonance frequency characteristic appearing in response to applying the first matching circuit of FIG. 12A to a power feeder of an antenna module according to an example embodiment. FIG. 13A illustrates a second matching circuit according to an example embodiment and FIG. 13B is a graph showing a resonance frequency characteristic appearing in response to applying the second matching circuit of FIG. 13A to a power feeder of an antenna module according to an example embodiment.

Figure 13B:
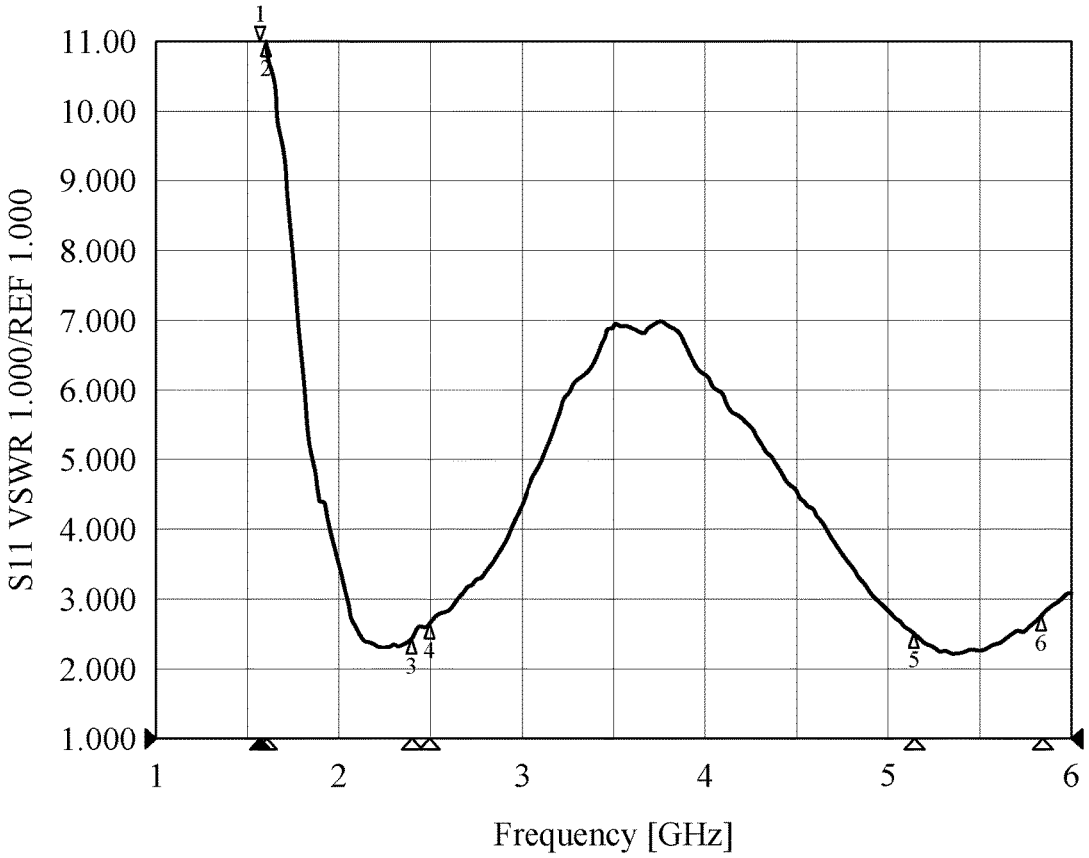
FIG. 13B is a graph showing a resonance frequency characteristic appearing in response to applying the second matching circuit of FIG. 13A to a power feeder of an antenna module according to an example embodiment.

Referring to FIGS. 12A and 12B and FIGS. 13A and 13B, the antenna module 1 may show a GPS resonance frequency characteristic as shown in FIG. 12B or may show a dual WiFi characteristic as shown in FIG. 13B in response to changing a matching circuit. It can be verified from FIGS. 12B and 13B that a resonance corresponding to a frequency band of 1.5 GHz to 6 GHz is formed in the antenna module 1. It can be known that an antenna characteristic is variable within the frequency band of minimum 1.5 GHz to 6 GHz, or more.

The general antenna structure shows a single resonance frequency characteristic based on a standardized condition using a predetermined power supplying leg or the predetermined power supplying leg and ground leg. However, the antenna module 1 according to an example embodiment may provide a multifunctional resonance frequency function by changing a signal pad and/or a ground pad, or by changing a matching circuit. The multifunctional resonance frequency function indicates a function of satisfying two or more available frequency bands by changing a peripheral condition using the same antenna module 1. FIGS. 12A through 13B illustrate examples of satisfying a GPS band and a dual WiFi band by changing a matching component using the same antenna module. It can be known that a resonance frequency impedance is adjustable within the band of 0.5 GHz to 6 GHz by changing a matching component. That is, in the antenna module 1 according to an example embodiment, it is possible to select a frequency band. Accordingly, it is possible to overcome inconveniences coming from using a plurality of antennas in different types under condition of supporting an unspecific multiband. For example, it is possible to save time, cost, effort, and the like, used for production.

Figure 14:
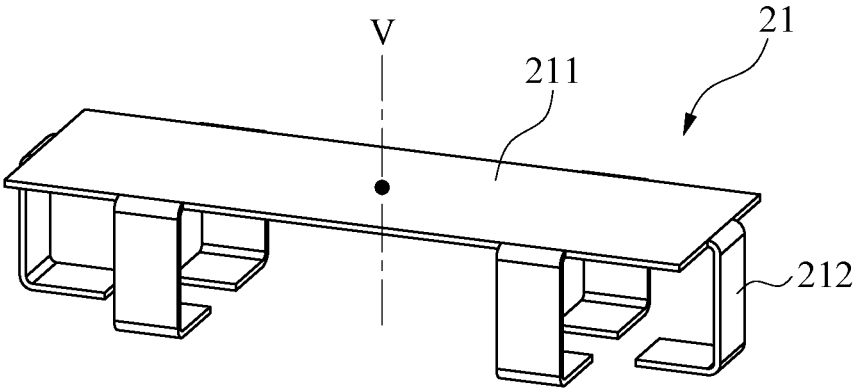
FIG. 14 is a perspective view illustrating an antenna according to another example embodiment.

FIG. 14 is a perspective view illustrating an antenna according to another example embodiment. Referring to FIG. 14, an antenna 21 according to another example embodiment may include a planar radiator 211 and a plurality of conductive legs 212. One or more conductive legs 212 may be at each edge of the planar radiator 211.

Figure 15:
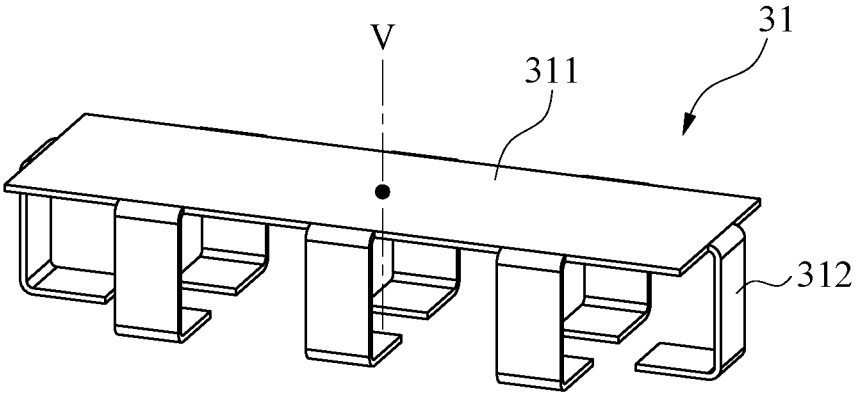
FIG. 15 is a perspective view illustrating an antenna according to another example embodiment.

FIG. 15 is a perspective view illustrating an antenna according to another example embodiment. Referring to FIG. 15, an antenna 31 according to another example embodiment may include a planar radiator 311 and a plurality of conductive legs 312. The number of the plurality of conductive legs 312 may be changed.

Figure 16:
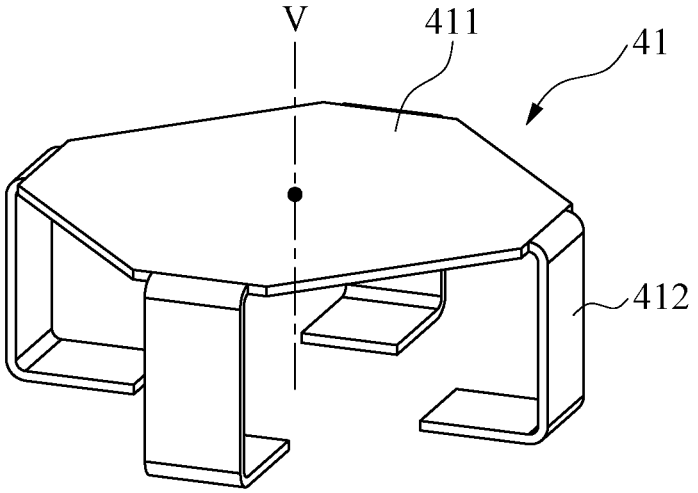
FIG. 16 is a perspective view illustrating an antenna according to another example embodiment.

FIG. 16 is a perspective view illustrating an antenna according to another example embodiment. Referring to FIG. 16, an antenna 41 according to another example embodiment may include a planar radiator 411 and a plurality of conductive legs 412. The antenna 41 may exhibit the same shape four times in response to a 360-degree rotation based on a single virtual line V.

Figure 17:
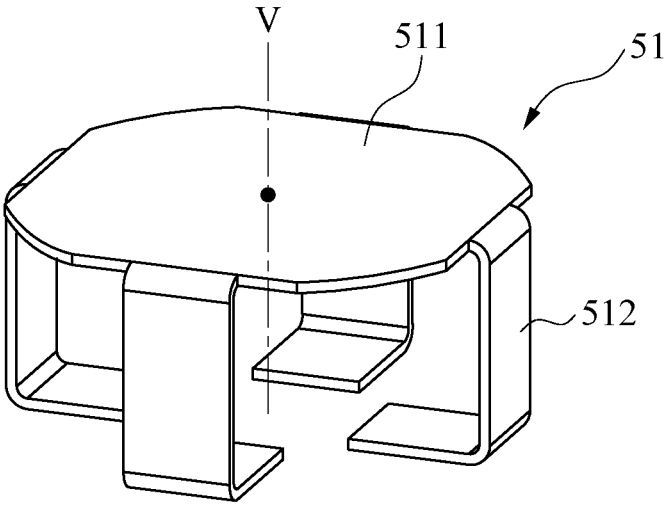
FIG. 17 is a perspective view illustrating an antenna according to another example embodiment.

FIG. 17 is a perspective view illustrating an antenna according to another example embodiment. Referring to FIG. 17, an antenna 51 according to another example embodiment may include a planar radiator 511 and a plurality of conductive legs 512. Chamfering processing may be performed on a corner of the planar radiator 511.

Figure 18:
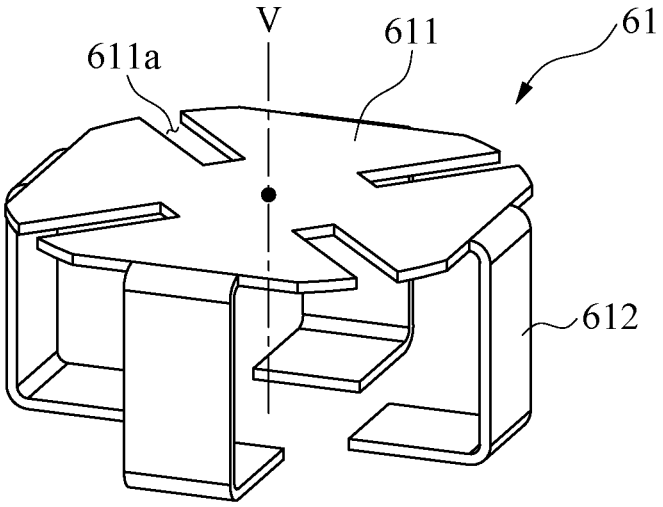
FIG. 18 is a perspective view illustrating an antenna according to another example embodiment.

FIG. 18 is a perspective view illustrating an antenna according to another example embodiment. Referring to FIG. 18, an antenna 61 according to another example embodiment may include a planar radiator 611 and a plurality of conductive legs 612. The planar radiator 611 may include a plurality of grooves 611*a* extending from the outer periphery of the planar radiator 611 toward the center of the planar radiator 611, that is, a virtual line V of FIG. 18. The plurality of grooves 611*a* may be symmetrically disposed to exhibit the same shape at least twice in response to a 360-degree rotation based on the single virtual line V. For example, referring to FIG. 18, the plurality of grooves 611*a* may be symmetrically disposed to exhibit the same shape four times in response to the 360-degree rotation based on the single virtual line V. Each of at least two grooves 611*a* among the plurality of grooves 611*a* may be provided in a shape of a slit having a length greater than a width. The groove 611*a* in the slit shape may move a resonance frequency of electric wave transmitted via the antenna 61 to a low frequency band by elongating the flow of current flowing in the antenna 61. That is, frequencies of electric waves transmitted via the antenna 61 may be easily adjusted by adjusting the length of the plurality of grooves 611*a*.

Figure 19:
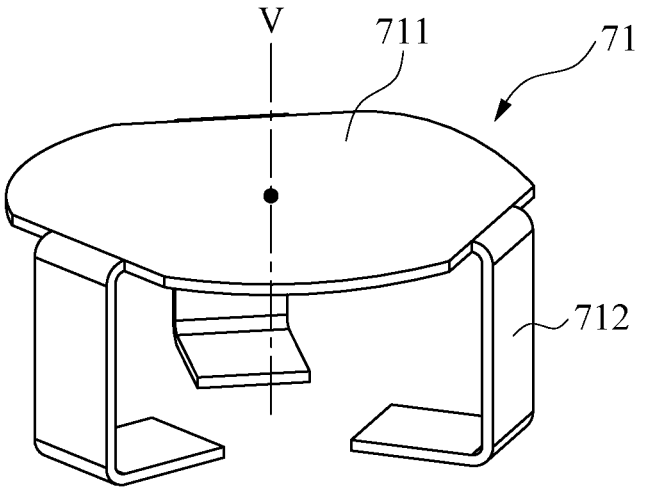
FIG. 19 is a perspective view illustrating an antenna according to another example embodiment.

FIG. 19 is a perspective view illustrating an antenna according to another example embodiment. Referring to FIG. 19, an antenna 71 according to another example embodiment may include a planar radiator 711 and a plurality of conductive legs 712. Here, the antenna 71 may exhibit the same shape three times in response to a 360-degree rotation based on a single virtual line V.

Figure 20:
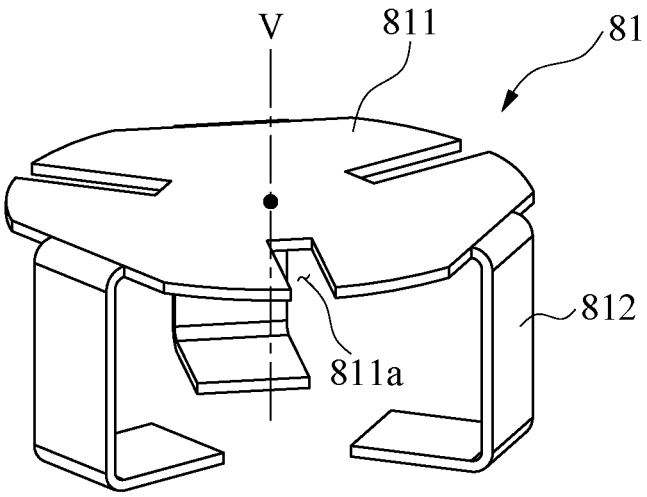
FIG. 20 is a perspective view illustrating an antenna according to another example embodiment.

FIG. 20 is a perspective view illustrating an antenna according to another example embodiment. Referring to FIG. 20, an antenna 81 according to another example embodiment may include a planar radiator 811 including a plurality of grooves 811*a* and a plurality of conductive legs 812.

According to the various example embodiments, regardless of a different antenna shape, radiation patterns may show similar results. Rather than indicating that shapes of radiation patterns are exactly the same, similar or a corresponding feature may be achieved, such as that of magnitudes and directions of current flowing in a single pair of antennas as shown in FIG. 5 are same, that it is possible to change a propagation direction of a radiation pattern by changing a location of a ground leg based on that a power supplying leg of an antenna is positioned at the center as shown in FIGS. 6 and 7, and the like.

According to some example embodiments, an individual antenna may form a symmetrical radiation pattern through a symmetrical shape of the individual antenna. Thus, if a plurality of antennas may be symmetrically disposed relative to an antenna module, the plurality of antennas may have the same mutual effect and interference effect, thereby making it possible to easily predict an entire radiation pattern. Also, since the individual antenna is in the symmetrical shape, the plurality of antennas used for the antenna module may be manufactured using a single mold. Also, a signal pad, a ground pad, and a fixing pad to be provided to a substrate of the antenna module may be switched and thereby used based on design specification. Thus, the productivity of the antenna module having a plurality of properties is enabled using the same substrate. In addition, since a radiation shape and characteristic vary based on a pad that is used for a power supplying leg, a single antenna module may be used for a plurality of purposes. Also, a general antenna structure may show a single resonance frequency characteristic based on a standardized condition using a predetermined power supplying leg and ground leg. However, according to some example embodiments, a multifunctional resonance frequency may be provided by variously modifying a circuit connected to an antenna module. Accordingly, it is possible to overcome inconveniences coming from using a plurality of antennas in different shapes under conditions of supporting a plurality of unspecific bands.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An antenna module comprising:

an antenna exhibiting the same shape at least twice in response to a 360-degree rotation based on a single virtual line and comprising a planar radiator and a plurality of conductive legs connected to the planar radiator; and a substrate comprising:

(a) a plurality of pads:

(1) in an alignment of two rows and three columns, (2) with each pad corresponding to one of the conductive legs of the antenna, (3) with each pad having one signal pad at the center of the plurality of pads that supplies current through one conductive leg, (4) with one ground pad on a first side of the one signal pad connected to one conductive leg and in the first row of the alignment, and (5) with a second ground pad on a second side of the at least one signal pad opposite from the first ground pad and in the second row of the alignment, and (b) a fixing fixed to one of the plurality of conductive legs pad at the center of the first row of the alignment.

2. An antenna module comprising:

an antenna:

(a) exhibiting the same shape at least twice in response to a 360-degree rotation based on a single virtual line and comprising a planar radiator and a plurality of conductive legs connected to the planar radiator, and (b) having the plurality of conductive legs connected to the planar radiator at the outer periphery of the planar radiator and exhibiting the same shape at least twice in response to the 360-degree rotation based on the single virtual line with each conductive leg having a vertical portion extending from the periphery of the planar radiator and a horizontal portion bent inward from the vertical portion; and a substrate comprising:

(a) a plurality of pads each corresponding to one of the conductive legs of the antenna and each of the pads having at least one signal pad at the center of the plurality of pads that supplies current through at least one conductive leg and the at least one signal pad, and (b) a first ground pad on a first side of the at least one signal pad and a second ground pad on a second side of the at least one signal pad opposite from the first ground pad, with at least one ground pad connected to at least one conductive leg.

3. An antenna module comprising:

an antenna:

(a) exhibiting the same shape at least twice in response to a 360-degree rotation based on a single virtual line and comprising a planar radiator and a plurality of conductive legs connected to the planar radiator, and (b) having the plurality of conductive legs connected to the planar radiator at the outer periphery of the planar radiator and exhibiting the same shape at least twice in response to the 360-degree rotation based on the single virtual line with each conductive leg having a vertical portion extending from the periphery of the planar radiator and a horizontal portion bent inward from the vertical portion; and a substrate comprising a plurality of pads each corresponding to one of the conductive legs of the antenna and each of the pads has at least one signal pad that supplies current through at least one conductive leg.

4. The antenna module of claim 3, wherein the plurality of pads has at least one ground pad connected to at least one conductive leg.

5. The antenna module of claim 3, wherein the plurality of pads further includes a fixing pad to fix to at least one conductive leg among the plurality of conductive legs using soldering.

* * * * *